US009630829B2

(12) United States Patent
Sokol

(10) Patent No.: US 9,630,829 B2
(45) Date of Patent: Apr. 25, 2017

(54) BOTTLE VALVE INSERT

(71) Applicant: Ronald Sokol, Estes Park, CO (US)

(72) Inventor: Ronald Sokol, Estes Park, CO (US)

( * ) Notice: Subject to any disclaimer, the term of this patent is extended or adjusted under 35 U.S.C. 154(b) by 20 days.

(21) Appl. No.: 14/339,010

(22) Filed: Jul. 23, 2014

(65) Prior Publication Data

US 2016/0023884 A1 Jan. 28, 2016

(51) Int. Cl.

| | |
|---|---|
| ***B65D 5/72*** | (2006.01) |
| ***B65D 25/40*** | (2006.01) |
| ***B65D 35/38*** | (2006.01) |
| ***B67D 3/02*** | (2006.01) |
| ***B65D 47/08*** | (2006.01) |
| ***B65D 47/20*** | (2006.01) |

(52) U.S. Cl.
CPC ..... *B67D 3/02* (2013.01); *B65D 47/08* (2013.01); *B65D 47/2031* (2013.01)

(58) Field of Classification Search
CPC ..... B67D 3/02; B65D 47/08; B65D 47/2031
USPC ..... 222/494, 490, 496, 495
See application file for complete search history.

(56) References Cited

U.S. PATENT DOCUMENTS 2,628,004 A * 2/1953 Schlicksupp ..... B65D 47/2081 222/493
4,141,474 A * 2/1979 Nilson ..... B65D 47/2081 222/493
4,785,978 A * 11/1988 Kano ..... B05B 11/047 215/309
5,692,651 A * 12/1997 Fuchs ..... B65D 47/2081 222/494
5,842,618 A * 12/1998 Julemont ..... B65D 47/2031 222/153.07
6,357,620 B1 * 3/2002 Hakim ..... A47G 19/2272 215/11.4
2003/0085240 A1 * 5/2003 Dark ..... B65D 47/2081 222/494
2006/0138179 A1 * 6/2006 Suffa ..... B65D 47/0804 222/490
2010/0163584 A1 * 7/2010 Wellman ..... B65D 47/2031 222/494
2013/0193170 A1 * 8/2013 Lehmkuhl ..... B65D 41/0471 222/494

* cited by examiner

*Primary Examiner* — Patrick M Buechner
*Assistant Examiner* — Jeremy W Carroll

(57) ABSTRACT

A bottle valve has a flapper valve and a base insert. The base insert can be pressure fit into the mouth of a beverage bottle. The insert has support members that extend from a sidewall towards the center. At the convergence of the support members is a dome seat. The flapper valve rests atop and inside the base insert and has a dispensing port. The port fits over the dome seat and presses against it to form a seal. When pressure is applied to the bottle, it is deformed and the liquid therein is forced to flow between the support members, pushing the flexible flapper seal away from the dome seat and allowing the liquid to flow out of the bottle mouth. When the pressure is relieved, the flapper seal returns to its rest position against the dome seat, reforming the seal and stopping air from flowing into the bottle.

18 Claims, 9 Drawing Sheets

BOTTLE VALVE INSERT

TECHNICAL FIELD

The present invention relates generally to the field of beverage containers, and more specifically, to a bottle valve insert for a beverage container.

BACKGROUND

There are a wide variety of beverages available to today's consumer, including: juice, wine, soda, beer, mineral water, etc. The plethora of beverage containers is almost as varied as the beverages themselves. Nevertheless, beverage containers often have common features such as a neck, round mouth, and screw on cap. Such containers are designed to hold beverages and release them when tipped by the consumer to pour the liquid into a glass or other serving container.

One common failing of beverage containers (hereafter, "bottles"), is that, once opened, they no longer prevent air from entering the container. Air contains oxygen, which can have a negative impact on the quality, palatability, taste, etc. of a beverage. For example, wine can become oxidized rather quickly and lose much of its character. Additionally, carbonated beverages can rapidly lose their carbonization if left open.

What is needed is a bottle valve insert that attaches to a bottle and allows fluid to pass through when pressure is applied to the bottle. When pressure is relieved and fluid is no longer forced out, the bottle valve insert should close, creating a seal and not allowing air to re-enter the bottle.

SUMMARY

One embodiment of the present invention comprises a bottle valve insert having a flapper valve and a base insert. The base insert can be pressure fit into the mouth of a beverage bottle. The insert has support members that extend from a sidewall of the base insert towards the center. The support members have spaces between them, allowing liquid to flow therethrough. At the convergence of the support members is a dome seat which is supported thereby. The flapper valve rests atop and inside the base insert and is made from a soft, flexible plastic/rubber/silicone/etc. type material. The top of the flapper valve is sealed to the top of the base insert. A flapper seal portion of the flapper valve extends downwards into the base insert and has a dispensing port therein. The port fits over the dome seat in the base insert and presses against the dome seat to form an air-tight seal. When a pressure is applied to the outside of the bottle, it is deformed and the liquid therein is forced to flow between the support members, pushing the flexible flapper seal away from the dome seat and allowing the liquid to flow out of the bottle mouth. When the pressure is relieved, the flapper seal portion quickly returns to its rest position against the dome seat, forming an air-tight seal and stopping air from flowing back into the bottle.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein.

DETAILED DESCRIPTION

Figure 1:
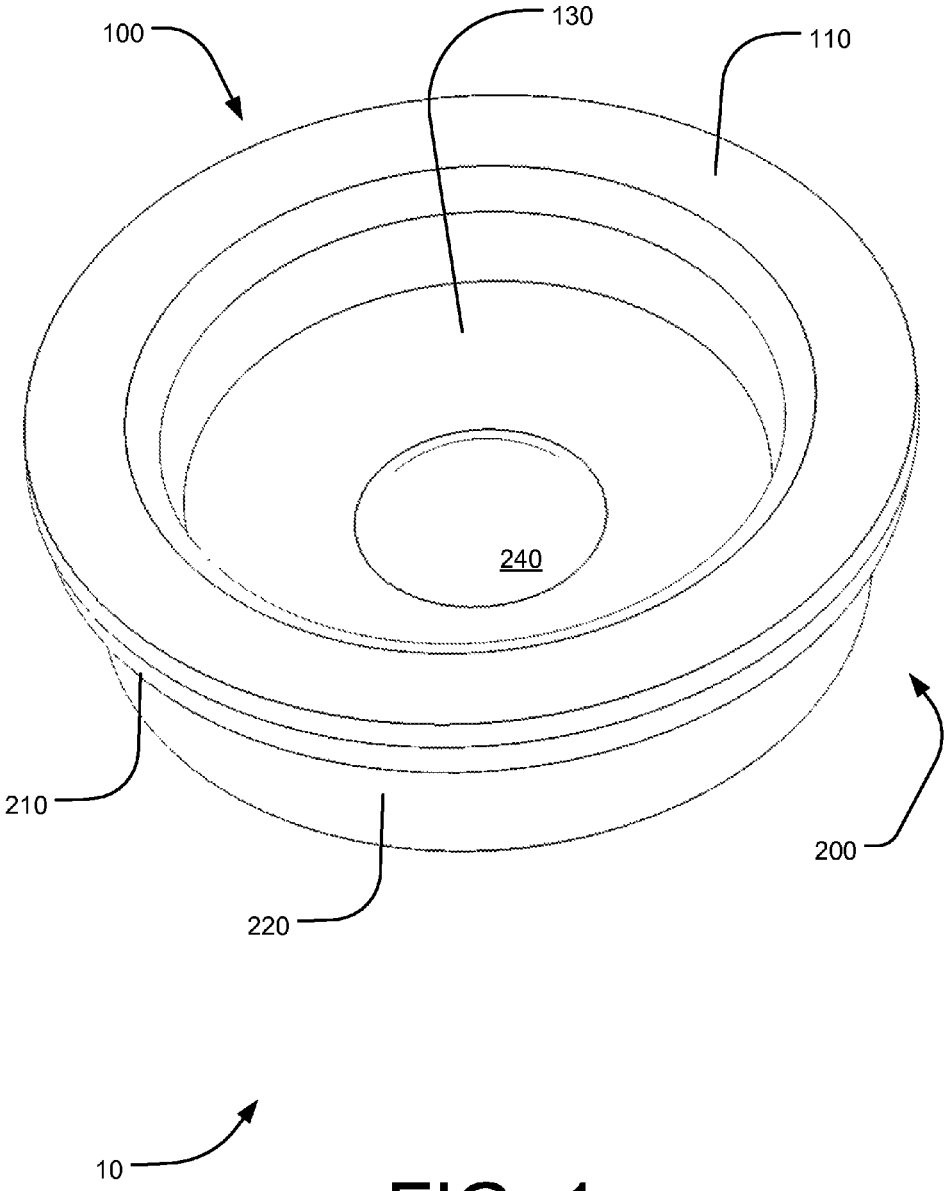
FIG. 1 illustrates a front perspective view of an exemplary embodiment of a bottle valve insert.

Referring now to the drawings, FIG. 1 illustrates a front perspective view of an exemplary embodiment of a bottle valve insert 10. The bottle valve insert comprises a flapper valve 100 and a base insert 200. The flapper valve 100 has an attachment lip 110 and a flapper seal 130 portion. The attachment lip 110 is a relatively flat extension of the flapper seal 130 portion that fits over the mouth of a beverage bottle. The flapper seal 130 extends downwards into the base insert 200 and then curves inwards towards a dome seat 240 portion of the base insert 200. A fluid dispensing port in the flapper seal 130 allows fluids to pass through the flapper seal. In another embodiment, a more angled construction for the flapper seal 130 is used versus the curved construction illustrated in the Figures. The flapper seal 130 can be constructed of any sufficiently flexible/pliable material that can form an air-tight seal with the dome seat 240. In another embodiment, the main portion of the flapper seal 130 can be made from one set of material(s) while the portion surrounding the fluid dispensing port of the flapper seal 130 can be made from another set of material(s).

The base insert 200 comprises a retention lip 210 that fits over the mouth of a beverage bottle between the mouth and the attachment lip 110. The attachment lip 110 can be affixed to the retention lip 210 such that no liquid from the bottle or air from outside the bottle can pass between them. Likewise, the sidewall 220 of the base insert 200 fits snugly inside the mouth of the bottle using a compression fit such that no air or liquid can pass between the sidewall 220 and the outside of the bottle. Although not shown in FIG. 1, a plurality of support members (see FIG. 4, items 231-234) is attached to the sidewall 220 and connects the sidewall 220 to the dome seat 240. The dome seat 240 is a dome-shaped member which extends upwards from the plurality of support members through the fluid dispensing port in the flapper seal 130.

When the bottle valve insert has been inserted into the mouth of a bottle, the sidewall 220 of the base insert 200 fits snugly against the inside of the mouth of the bottle, forming a seal therebetween. The retention lip 210 rests against the top of the mouth of the bottle and the attachment lip 110 is positioned above the retention lip 210. When a pressure is applied to the exterior of the bottle (such as when the body of the bottle is squeezed), the liquid inside the bottle is forced between the support members and pushes the flapper seal 130 up and away from the dome seat 240, breaking the seal therebetween and allowing the liquid to exit the bottle. Once the pressure is relieved, the flapper seal 130 returns to its normal position against the dome seat 240, forming a seal therewith and keeping air from entering the bottle.

Figure 2:
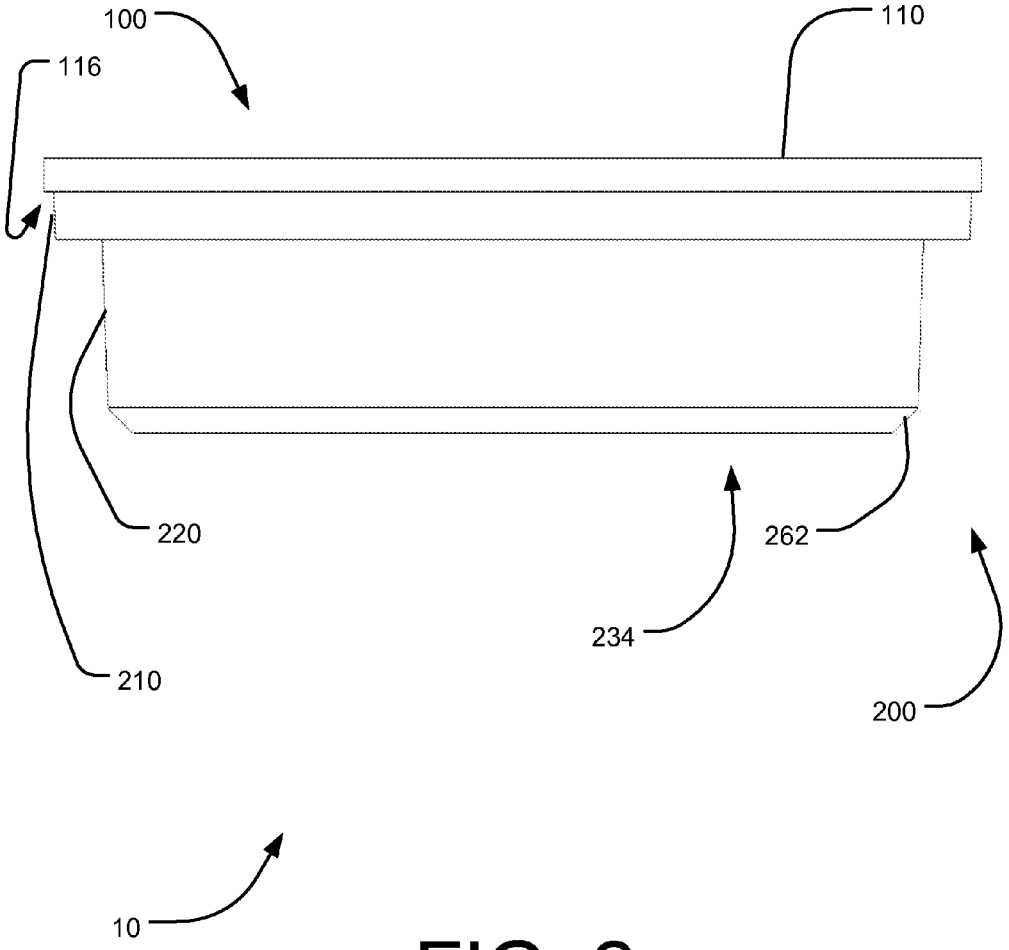
FIG. 2 illustrates a side elevation view of an exemplary embodiment of a bottle valve insert.

FIG. 2 illustrates a side elevation view of an exemplary embodiment of a bottle valve insert 10. The bottle valve insert comprises a flapper valve 100 and a base insert 200. The flapper valve 100 has an attachment lip 110 that fits above the retention lip 210 of the base insert 200. The attachment lip 110 may extend slightly beyond the edge of the retention lip 210 creating an overhang 116. This overhang 116 is designed to hold the bottle valve insert inside the cap of a bottle by creating a compression fit against the sidewall of the cap. When the cap is attached to the bottle, the bottle valve insert is inserted into the mouth of the bottle and fits snugly therein. The cap can then be removed from the bottle, leaving the bottle valve insert within the mouth of the bottle. In another embodiment, no slight extension or overhang is present.

The base insert 200 comprises a retention lip 210 that fits over the mouth of a beverage bottle between the mouth and the attachment lip 110. The attachment lip 110 can be affixed to the retention lip 210 such that no liquid from the bottle or air from outside the bottle can pass between them. Likewise, the sidewall 220 of the base insert 200 fits snugly inside the mouth of the bottle using a compression fit such that no air or liquid can pass between the sidewall 220 and the outside of the bottle.

Note that the transition 262 between the sidewall 220 and the plurality of support members 231-234 (see FIG. 4 for more detail on the support members) is illustrated in FIG. 2 as being angled at approximately forty five degrees. This angled transition 262 helps to center the base insert into the mouth of the bottle during insertion. In other embodiments, the transition 262 can be curved, less angled, or more angled.

Figure 3:
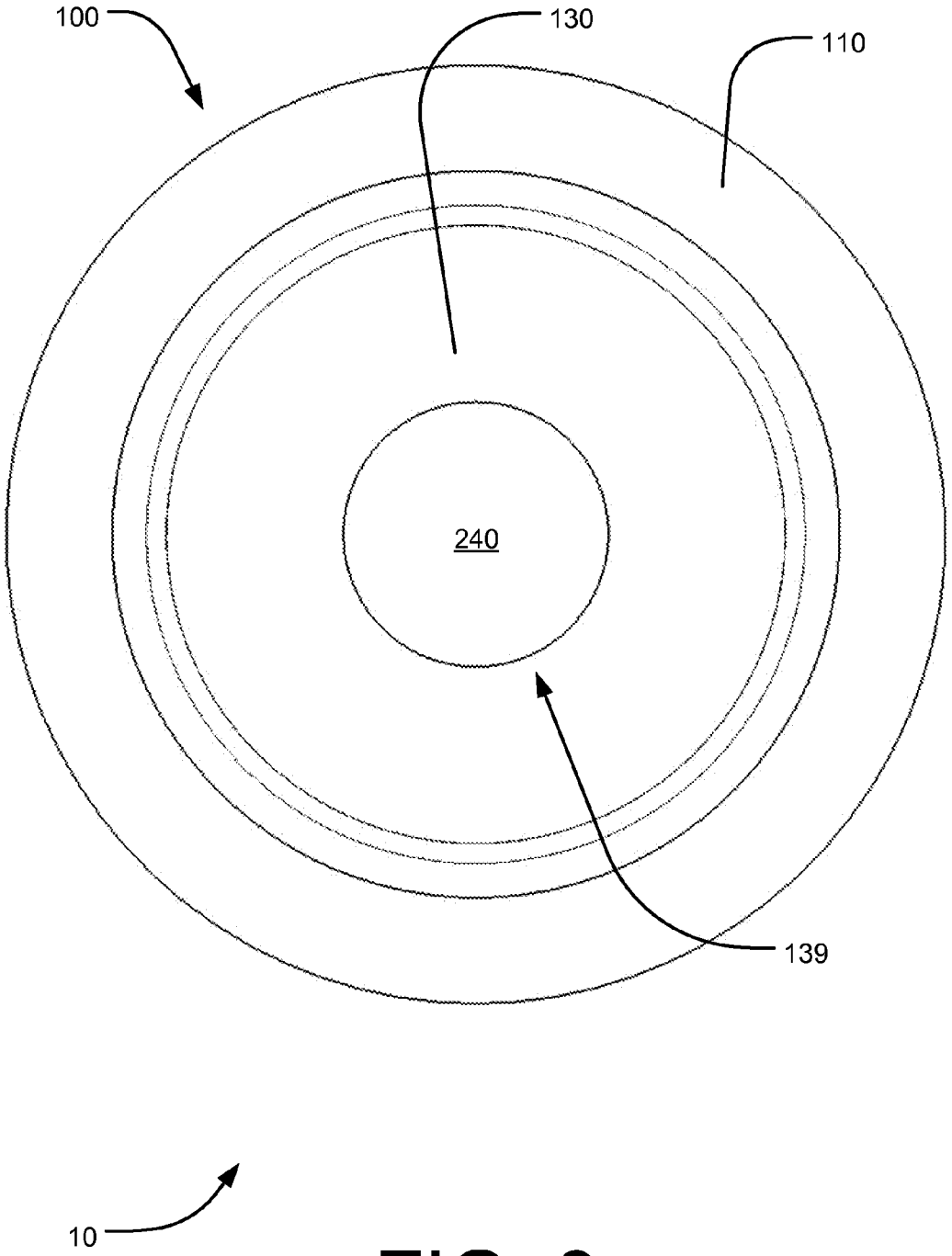
FIG. 3 illustrates a top plan view of an exemplary embodiment of a bottle valve insert.

FIG. 3 illustrates a top plan view of an exemplary embodiment of a bottle valve insert 10. The flapper valve 100 is the portion that is mainly visible as the base insert 200 is mostly located below the flapper valve 100. The flapper valve 100 has an attachment lip 110 that is generally annular in shape and a flapper seal 130 portion. The attachment lip 110 is a relatively flat extension of the flapper seal 130 portion that fits over the mouth of a beverage bottle. The flapper seal 130 extends downwards into the base insert and then curves inwards towards the dome seat 240. The dome seat 240 is a dome-shaped member which extends upwards from the plurality of support members through the fluid dispensing port 139 in the flapper seal 130.

In the embodiment illustrated in FIG. 3, the dome seat 240 is shown as having a generally circular shape when viewed from above. Other shapes are contemplated. Similarly, the fluid dispensing port 139 is circular in shape to match the dome seat 240 in FIG. 3, in other embodiments, the port 139 can have other shapes to match the dome seat 240 and form a seal therewith.

Figure 4:
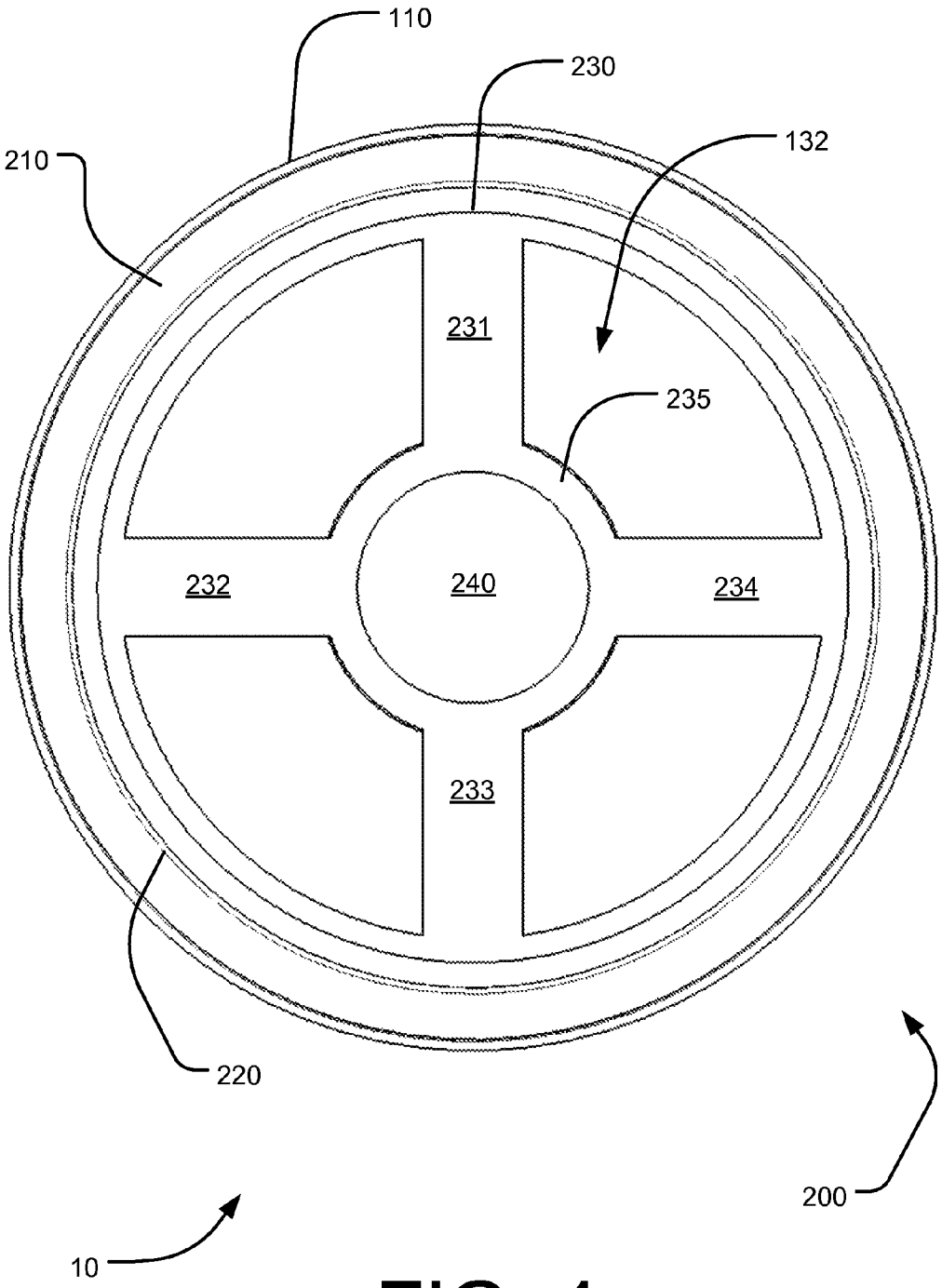
FIG. 4 illustrates a bottom plan view of an exemplary embodiment of a bottle valve insert.

FIG. 4 illustrates a bottom plan view of an exemplary embodiment of a bottle valve insert 10. As this view is from the bottom, little of the flapper valve 100 is visible: the attachment lip 110 can be seen as the slight overhang portion (see FIG. 2, item 116) extends beyond the retention lip 210 of the base insert 200. The retention lip 210 has an annular shape so as to fit over the mouth of most beverage bottles and form a seal therewith. Extending from the retention lip 210 is the sidewall 220 of the base insert 200. The sidewall 220 extends downwards into the mouth of the bottle when the bottle valve insert is placed within the bottle mouth. Extending inwards from the sidewall 220 is the base 230 of the base insert 200.

In the embodiment illustrated in FIG. 4, the base 230 is annular in shape and has a plurality of support members 231-234 extending radially inwards therefrom. Four support members 231-234 are illustrated; in other embodiments more of fewer can be utilized. At the juncture of the plurality of support members 231-234 is a dome support 235. This portion of the base insert 200 connects the plurality of the support members 231-234 to the dome seat 240. The dome seat extends upwards (in this view, away from the viewer) from the dome support 235. Between the plurality of the support members 231-234 is a plurality of openings 132 that allow liquid from inside the bottle to pass therethrough when the bottle is squeezed.

Figure 5:
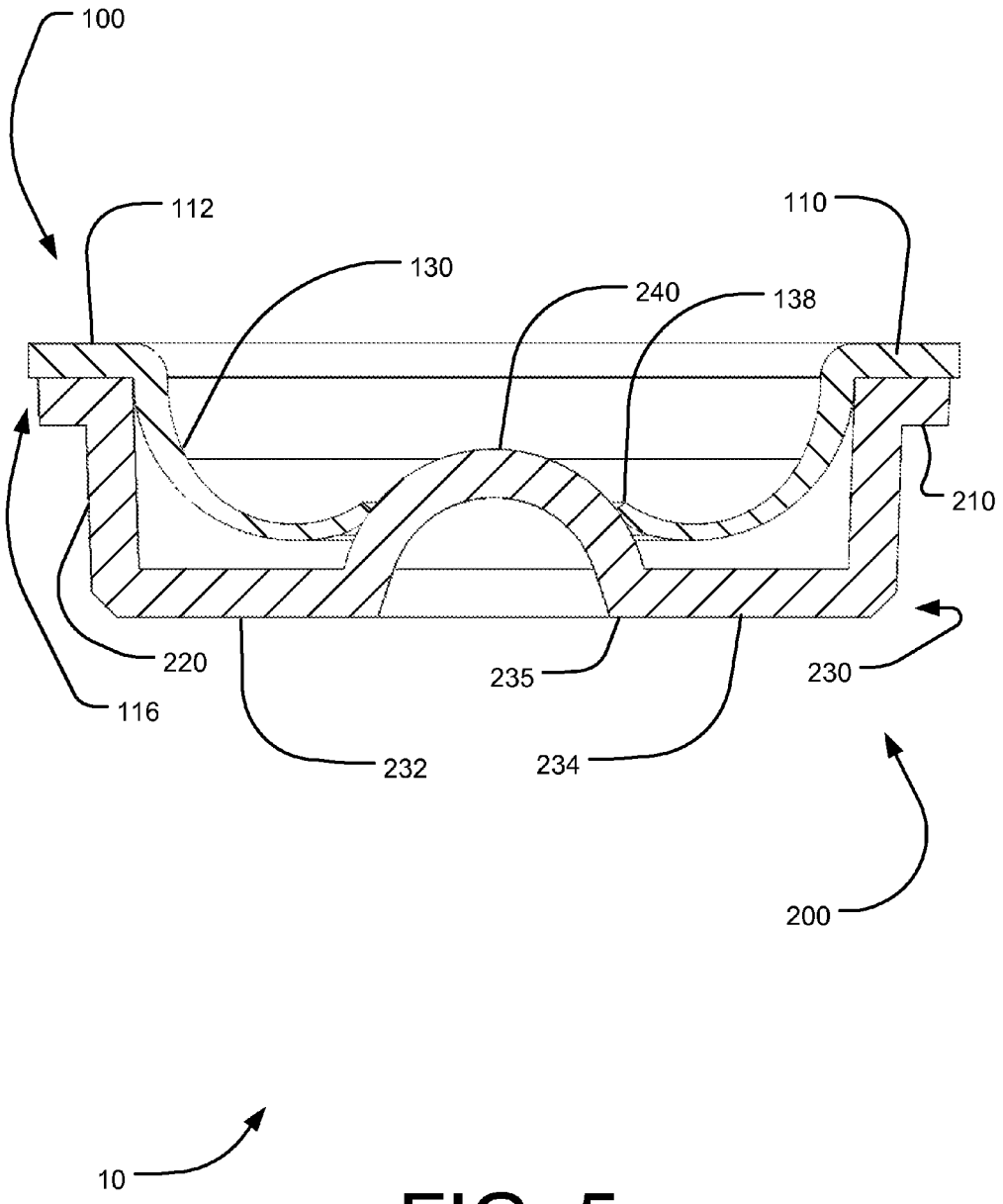
FIG. 5 illustrates a side cross-sectional view of an exemplary embodiment of a bottle valve insert.

FIG. 5 illustrates a side cross-sectional view of an exemplary embodiment of a bottle valve insert 10. This view provides a good illustration of the flapper seal 130 and how it contacts the dome seat 240 to form a seal therebetween. The seal lip 138 of the flapper seal 130 presses against the dome seat 240 and keeps air from entering the bottle. The flapper seal 130 extends from the attachment lip 110, downwards into the base insert 200. As it progresses downwards, it is curved back upwards by contact with the dome seat 240. If the dome seat was not present, the flapper seal 130 would continue to extend downwards. Thus, the deformation of the flapper seal 130 by the dome seat 240 causes the flapper seal 130 to press tightly against the dome seat 240. The material (s) from which the flapper seal 130 is constructed must be sufficiently flexible and resilient to accommodate the deformation and hold the seal. Silicone, soft plastic, rubber, or similar can be used. The seal lip 138 can be made from similar materials or a dedicated air-tight sealing material can be used instead.

The cross-sectional view illustrated in FIG. 5, shows the slight wedge shaped nature of the sidewall 220 of the base insert 200. The exterior surface of the sidewall 220 is angled slightly inwards as you progress from the retention lip 210 downwards to the base 230 so that it fits inside the mouth of a bottle. As the bottle valve insert is pressed into the mouth, the sidewall contacts the interior surface of the mouth and is compressed. This compression forms a tight seal between the sidewall 220 of the base insert 200 and the bottle. In another embodiment, the sidewall 200 is not angled and instead the junction between the retention lip 210 and the bottle mouth is where the seal is formed (for example, a compression fit with a deformable material may form the seal, or an adhesive or sealant could be applied at said junction to form the seal).

Figure 6A:
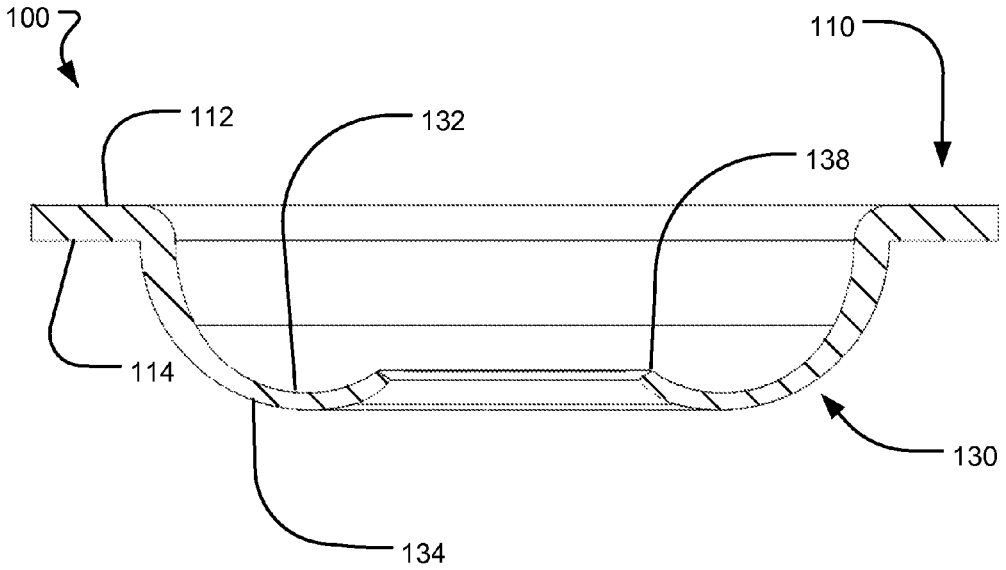
FIG. 6A illustrates a side cross-sectional view of an exemplary embodiment of a flapper valve.
Figure 6B:
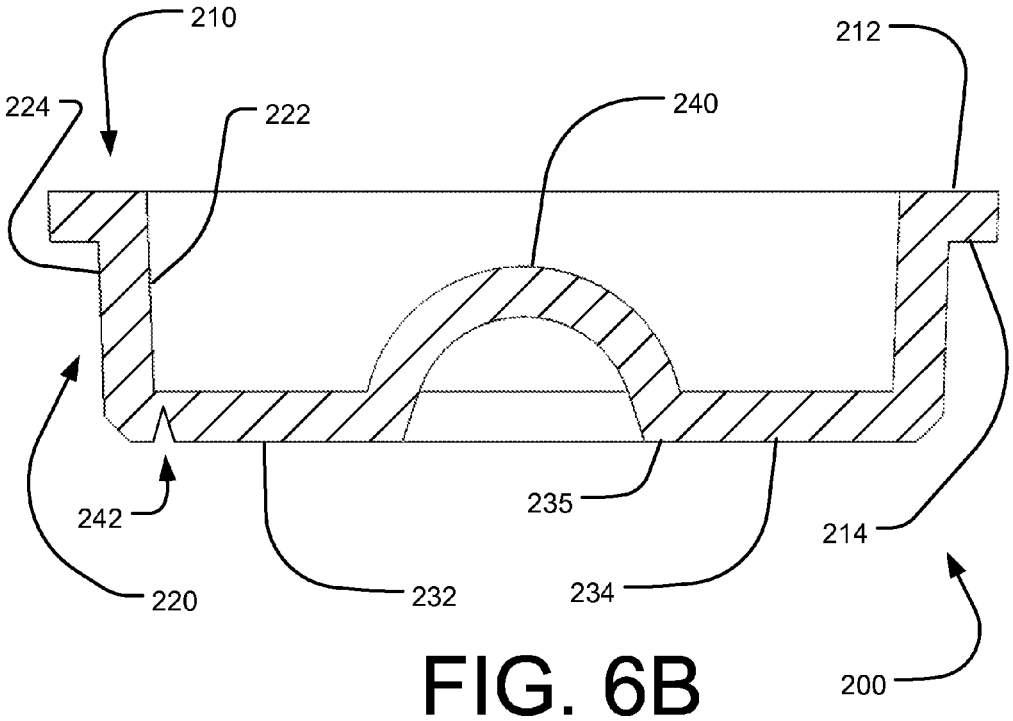
FIG. 6B illustrates a side cross-sectional view of an exemplary embodiment of a base insert.

FIG. 6A illustrates a side cross-sectional view of an exemplary embodiment of a flapper valve 100 without the base insert 200 (see FIG. 6B for more detail of the base insert 200). The attachment lip 110 is illustrated in FIG. 6A and the attachment lip top surface 112 and attachment lip bottom surface 114 are labeled. Note how the flapper seal 130 extends downwards from the attachment lip 110 and then curves slightly upwards before terminating in the seal lip 138. The concave surface 132 of the flapper seal 130 is illustrated in FIG. 6A as is the convex surface 134. Although the dome seat 240 is not present in FIG. 6A, the flapper seal 130 is still shown in its deformed position in order to illustrate the components in their normal positions.

FIG. 6B illustrates a side cross-sectional view of an exemplary embodiment of a base insert 200 without the flapper valve 100. The retention lip 210 is illustrated in FIG. 6B and the retention lip top surface 212 and retention lip bottom surface 214 are labeled. When the flapper valve 100 is attached to the base insert 200, the attachment lip bottom surface 114 contacts the retention lip top surface 212. And when the bottle valve insert is placed within the mouth of a bottle, the retention lip bottom surface 214 is in contact with the top of the bottle mouth.

The cross-sectional view illustrated in FIG. 6B, shows the slight wedge shaped nature of the sidewall 220 of the base insert 200. The sidewall exterior surface 224 is angled slightly inwards as you progress from the retention lip 210 downwards to the base so that it fits inside the mouth of a bottle. As the bottle valve insert is pressed further into the mouth, the sidewall exterior surface 224 contacts the interior surface of the mouth and is compressed. This compression forms a tight seal between the sidewall 220 of the base insert 200 and the bottle. In another embodiment, the sidewall 200 is not angled and instead the junction between the retention lip 210 and the bottle mouth is where the seal is formed (for example, an adhesive or sealant could be applied at said junction to form the seal). The sidewall interior surface 222 is also illustrated in FIG. 6B as being angled slightly. In other embodiments, the sidewall interior surface 222 is straight.

In the embodiment illustrated in FIG. 6B, a pre-stressed breakaway feature 242 is shown. This feature allows a consumer to break away the dome seat 240 from the sidewall 220 of the base insert, thereby permanently breaking the seal between the dome seat 240 and the flapper seal 130. This is done to allow any final remaining liquid in the bottle to exit the bottle.

The cutout portion of the support member 232 is shown in FIG. 6B as being a small "v" shaped cut in the support member 232. The breakaway feature 242 provides a weak point in the structure of the support member 232 such that downwards pressure on the dome seat 240 would cause the support member 232 to breakaway from the sidewall 220. It is contemplated that a second neighboring support member, say support member 231, could also have a similar breakaway feature. Pressing downwards on the dome seat 240 causes both of those breakaway features to break away from the sidewall, thereby causing the dome seat 240 to hinge downwards into the bottle away from the flapper seal 130. Once the seal lip 138 no longer contacts the dome seat 240, any remaining fluid in the bottle could then exit through the fluid dispensing port 139. In other embodiments, other means of weakening the support members in order to allow them to easily "break away" are contemplated.

Figure 7:
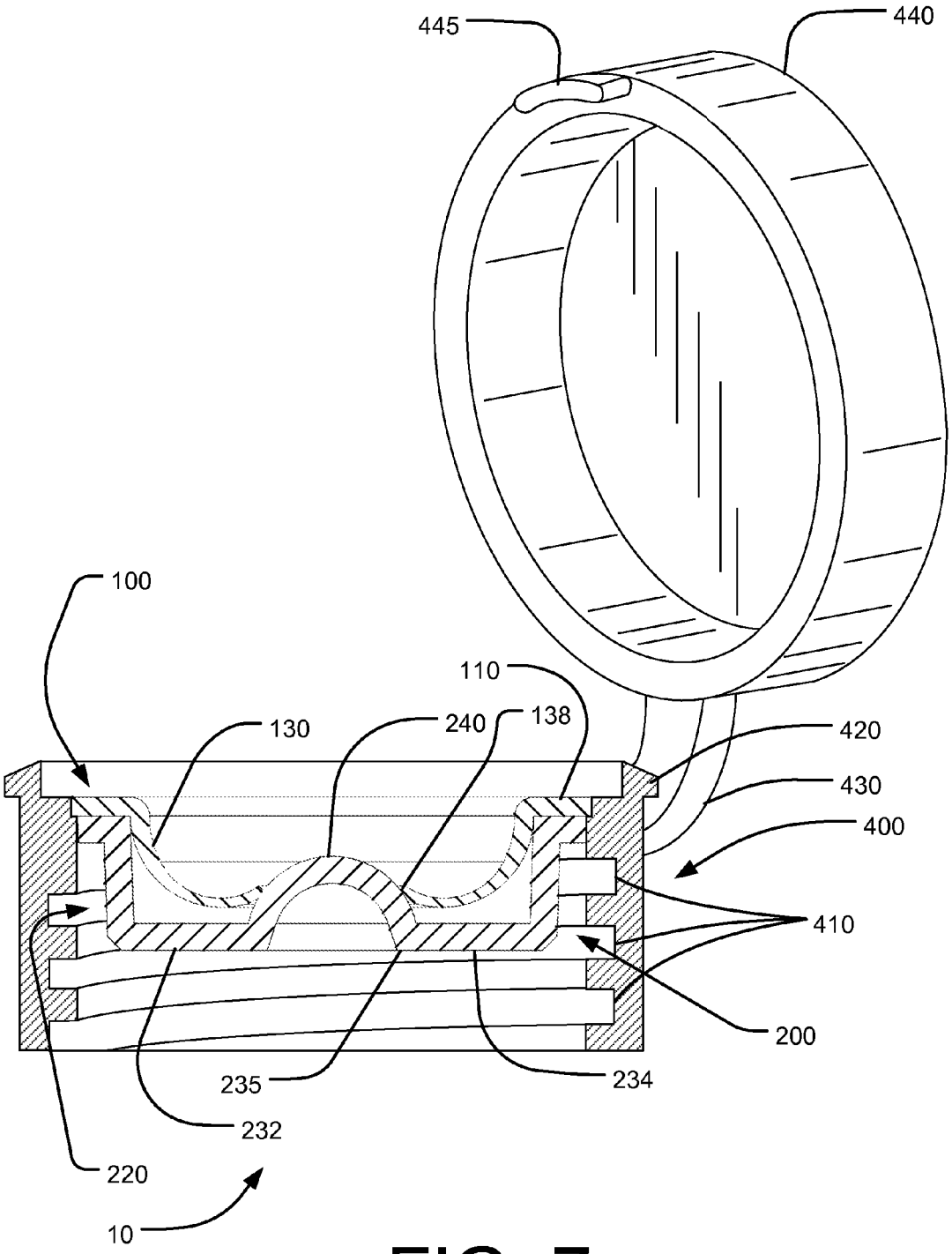
FIG. 7 illustrates a side cross-sectional perspective view of an exemplary embodiment of a bottle valve insert having a screw on cap and a snap lid.

FIG. 7 illustrates a side cross-sectional perspective view of an exemplary embodiment of a bottle valve insert 10 having a screw on cap 400 and a snap lid 440. In this embodiment, the bottle valve insert 10 incorporates a screw on cap 400 for screwing the bottle valve insert 10 onto a bottle (soda bottle, water bottle, etc.). The screw on cap 400 includes internal threads 410 and a snap seal ring 420 to seal the snap lid 440 in place when snapped down onto the screw on cap 400. There are a variety of thread patterns used on bottles, and it is contemplated that the bottle valve insert 10 can employ any thread pattern.

The snap lid 440 can be hingeably attached to the screw on cap 400 via a snap lid hinge 430. Once closed, the snap lid 440 can be easily opened by pressing up on the snap lid tab 445. In other embodiments, other types of closure lids/systems are contemplated.

The seal lip 138 of the flapper seal 130 presses against the dome seat 240 and keeps air from entering the bottle. The flapper seal 130 extends from the attachment lip 110, downwards into the base insert 200. As it progresses downwards, it is curved back upwards by contact with the dome seat 240. If the dome seat was not present, the flapper seal 130 would continue to extend downwards. Thus, the deformation of the flapper seal 130 by the dome seat 240 causes the flapper seal 130 to press tightly against the dome seat 240. The material (s) from which the flapper seal 130 is constructed must be sufficiently flexible and resilient to accommodate the deformation and hold the seal. Silicone, soft plastic, rubber, or similar can be used. The seal lip 138 can be made from similar materials or a dedicated air-tight sealing material can be used instead.

The cross-sectional view illustrated in FIG. 7, shows the slight wedge shaped nature of the sidewall 220 of the base insert 200. The exterior surface of the sidewall 220 is angled slightly inwards as you progress from the retention lip 210 downwards to the base so that it fits inside the mouth of a bottle. As the bottle cap with valve insert is screwed onto the bottle, the sidewall contacts the interior surface of the mouth and is compressed. This compression forms a tight seal between the sidewall 220 of the base insert 200 and the bottle. In another embodiment, the sidewall 200 is not angled and instead the junction between the retention lip 210 and the bottle mouth is where the seal is formed (for example, a compression fit with a deformable material may form the seal, or an adhesive or sealant could be applied at said junction to form the seal).

Figure 8:
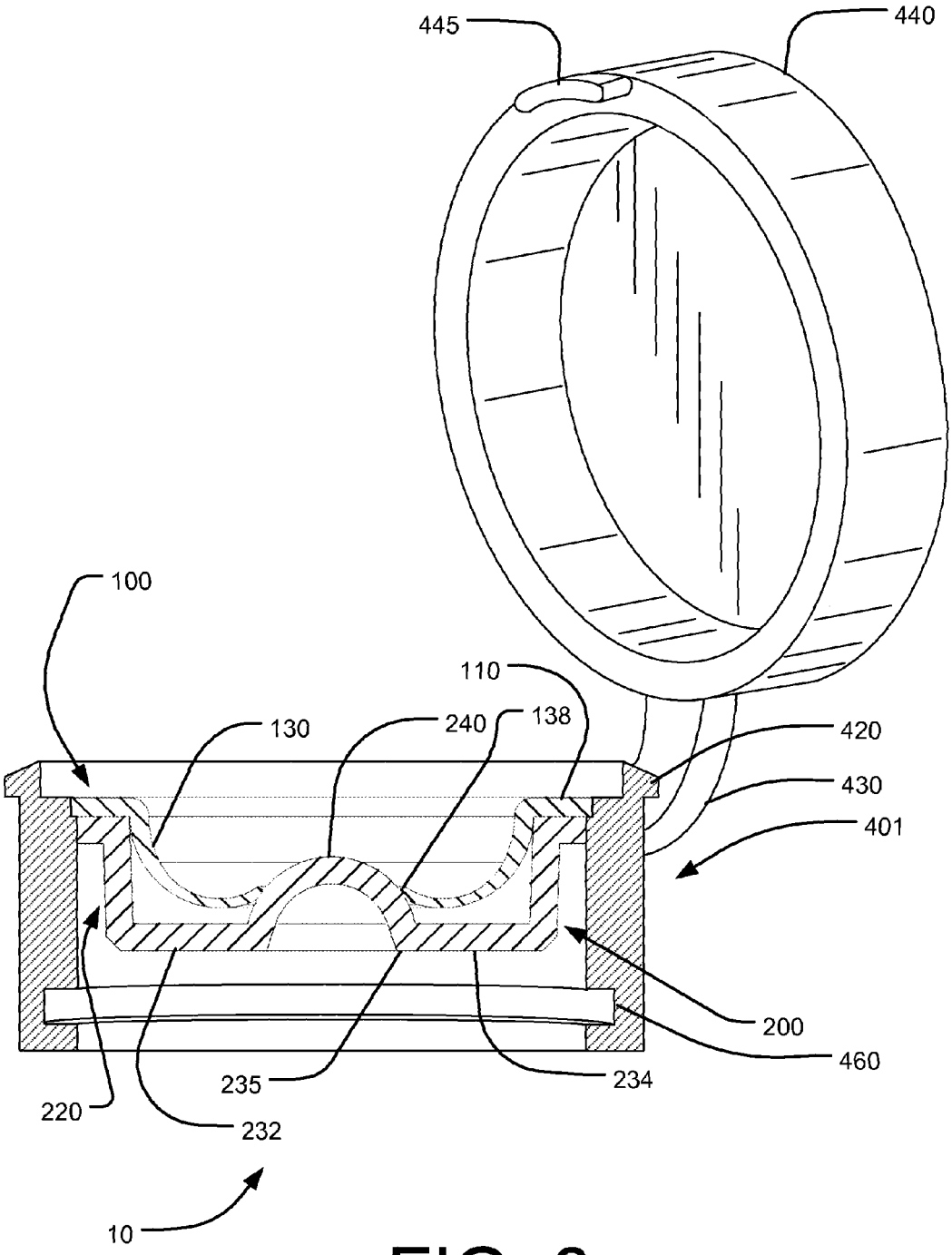
FIG. 8 illustrates a side cross-sectional perspective view of an exemplary embodiment of a bottle valve insert having a snap on cap and a snap lid.

FIG. 8 illustrates a side cross-sectional perspective view of an exemplary embodiment of a bottle valve insert 10 having a snap on cap 401 and a snap lid 440. In this embodiment, the bottle valve insert 10 incorporates a snap on cap 401 for snapping the bottle valve insert 10 onto a bottle (soda bottle, water bottle, etc.). The snap on cap 401 does not have internal threads like the embodiment shown in FIG. 7, instead, it utilizes a snap on ring 460 which snaps over a retention protrusion on a bottle. There are a variety of sizes and shapes for retention protrusions used on bottles, and it is contemplated that the bottle valve insert 10 can be employed with any of them.

Figure 9:
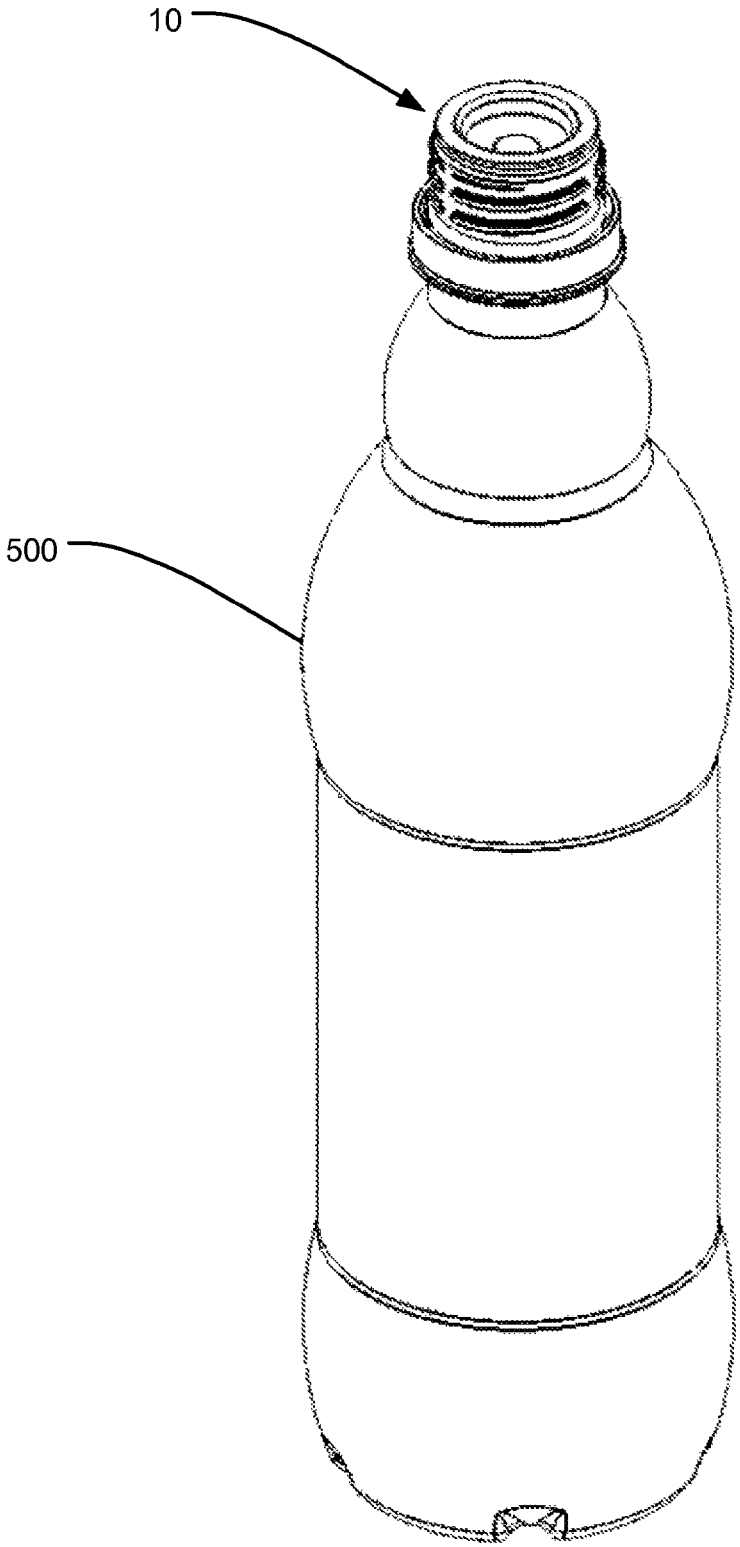
FIG. 9 illustrates a perspective view of an exemplary embodiment of a bottle valve insert in place within the mouth of a bottle.

FIG. 9 illustrates a perspective view of an exemplary embodiment of a bottle valve insert 10 in place within the mouth of a bottle 500. Note that the majority of the bottle valve 10 is within the mouth of the bottle 500. In this embodiment, a compression fit is used (see FIGS. 1, 2, and 5 for similar embodiments using compression fit).

While particular embodiments of the invention have been described and disclosed in the present application, it should be understood that any number of permutations, modifications, or embodiments may be made without departing from the spirit and scope of this invention. Accordingly, it is not the intention of this application to limit this invention in any way except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above "Detailed Description" section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

In light of the above "Detailed Description," the Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The above specification, examples and data provide a description of the structure and use of exemplary implementations of the described articles of manufacture and methods. It is important to note that many implementations can be made without departing from the spirit and scope of the invention.

What is claimed is:

1. A bottle valve insert, comprising:

a flapper valve and a base insert;

the flapper valve portion comprising an annular attachment lip and a flapper seal;

the attachment lip comprising a generally flat annular extension of the flapper seal;

the attachment lip having an attachment lip top surface and an attachment lip bottom surface, the attachment lip top surface and the attachment lip bottom surface are joined together by an outer perimeter sidewall of the annular attachment lip;

the flapper seal extending downwards from the attachment lip into the base insert and transitioning inwards and upwards towards a dome seat;

the flapper seal having an inner perimeter, the flapper seal contacting the dome seat along the inner perimeter and forming a first seal with the dome seat;

a fluid dispensing port in the flapper seal allowing a fluid to pass through the flapper seal when the first seal is broken;

the fluid dispensing port comprising a circular hole in the flapper seal, the fluid dispensing port extending inwards from the inner perimeter;

the dome seat forming a dome extending upwards through the fluid dispensing port in the flapper seal;

the base insert comprising an annular retention lip, a sidewall, and a base, wherein the retention lip fits over a mouth of a beverage bottle;

the attachment lip fits over the retention lip and forms a second seal therewith;

an upper surface of the retention lip resting against the bottom surface of the attachment lip;

the sidewall attaching to the attachment lip, and extending downwards therefrom;

the sidewall forming an annular ring positioned between the attachment lip and the base;

the base extending inwards from the sidewall and attached thereto;

the base comprising a plurality of support members and the dome seat;

the plurality of support members extending radially inwards towards the dome seat, each support member having a distal end and a proximal end and wherein the distal end is attached to the dome seat; and wherein the dome seat is a dome-shaped member extending upwards from the plurality of support members through the fluid dispensing port in the flapper seal; and a breakaway feature that allows a consumer to break away the dome seat, thereby breaking the first seal between the dome seat and the flapper seal.

2. The bottle valve insert of claim 1 wherein the attachment lip extends beyond the retention lip creating an overhang therewith, and wherein the overhang holds the bottle valve insert inside a cap by creating a compression fit against an interior sidewall.

3. The bottle valve insert of claim 2, wherein the base further comprises:

a transition between the sidewall and the plurality of support members; and the transition having an angled portion.

4. The bottle valve insert of claim 3, wherein the dome seat further comprises:

a dome support portion and a dome top portion; and wherein the dome support portion is attached to at least one of the plurality of support members and the flapper seal rests upon the dome top portion and forms the first seal therewith.

5. The bottle valve insert of claim 2, wherein the dome seat further comprises:

a dome support portion and a dome top portion; and wherein the dome support portion is attached to at least one of the plurality of support members and the flapper seal rests upon the dome top portion and forms the first seal therewith.

6. The bottle valve insert of claim 1, wherein the base further comprises:

a transition between the sidewall and the plurality of support members; and the transition having an angled portion.

7. The bottle valve insert of claim 6, wherein the dome seat further comprises:

a dome support portion and a dome top portion; and wherein the dome support portion is attached to at least one of the plurality of support members and the flapper seal rests upon the dome top portion and forms the first seal therewith.

8. The bottle valve insert of claim 1, wherein the dome seat further comprises:

a dome support portion and a dome top portion; and wherein the dome support portion is attached to at least one of the plurality of support members and the flapper seal rests upon the dome top portion and forms the first seal therewith.

9. The bottle valve insert of claim 1, wherein the breakaway feature further comprises a cutout portion on at least one of the plurality of support members.

10. A bottle valve insert, comprising:

a flapper valve and a base insert;

the flapper valve portion comprising an annular attachment lip and a flapper seal;

the attachment lip comprising a generally flat annular extension of the flapper seal;

the attachment lip having an attachment lip top surface and an attachment lip bottom surface, the attachment lip top surface and the attachment lip bottom surface are joined together by an outer perimeter sidewall of the annular attachment lip;

the flapper seal extending downwards from the attachment lip into the base insert and transitioning inwards and upwards towards a dome seat;

the flapper seal having an inner perimeter, the flapper seal contacting the dome seat all along the inner perimeter and forming a first seal with the dome seat;

a fluid dispensing port in the flapper seal allowing a fluid to pass through the flapper seal when the first seal is broken;

the fluid dispensing port comprising a circular hole in the flapper seal, the fluid dispensing port extending inwards from the inner perimeter;

the dome seat forming a dome extending upwards through the fluid dispensing port in the flapper seal;

the base insert comprising an annular retention lip, a sidewall, and a base, wherein the retention lip fits over a mouth of a beverage bottle;

the attachment lip fits over the retention lip and forms a second seal therewith;

an upper surface of the retention lip resting against the bottom surface of the attachment lip;

the sidewall attaching to the attachment lip, extending downwards therefrom, and forming a first compression fit against an interior surface of a bottle neck;

the sidewall forming an annular ring positioned between the attachment lip and the base;

the base extending inwards from the sidewall and attached thereto;

the base comprising a plurality of support members and the dome seat;

the plurality of support members extending radially inwards towards the dome seat, each support member having a distal end and a proximal end and wherein the distal end is attached to the dome seat; and wherein the dome seat is a dome-shaped member extending upwards from the plurality of support members through the fluid dispensing port in the flapper seal; and a breakaway feature that allows a consumer to break away the dome seat, thereby breaking the first seal between the dome seat and the flapper seal.

11. The bottle valve insert of claim 10 wherein the attachment lip extends beyond the retention lip creating an overhang therewith, and wherein the overhang holds the bottle valve insert inside a cap by creating a second compression fit against an interior sidewall.

12. The bottle valve insert of claim 11, wherein the base further comprises:

a transition between the sidewall and the plurality of support members; and the transition having an angled portion.

13. The bottle valve insert of claim 12, wherein the dome seat further comprises:

a dome support portion and a dome top portion; and wherein the dome support portion is attached to at least one of the plurality of support members and the flapper seal rests upon the dome top portion and forms the first seal therewith.

14. The bottle valve insert of claim 11, wherein the dome seat further comprises:

a dome support portion and a dome top portion; and wherein the dome support portion is attached to at least one of the plurality of support members and the flapper seal rests upon the dome top portion and forms the first seal therewith.

15. The bottle valve insert of claim 10, wherein the base further comprises:

a transition between the sidewall and the plurality of support members; and the transition having an angled portion.

16. The bottle valve insert of claim 15, wherein the dome seat further comprises:

a dome support portion and a dome top portion; and wherein the dome support portion is attached to at least one of the plurality of support members and the flapper seal rests upon the dome top portion and forms the first seal therewith.

17. The bottle valve insert of claim 10, wherein the dome seat further comprises:

a dome support portion and a dome top portion; and wherein the dome support portion is attached to at least one of the plurality of support members and the flapper seal rests upon the dome top portion and forms the first seal therewith.

18. The bottle valve insert of claim 11, wherein the breakaway feature further comprises a cutout portion on at least one of the plurality of support members.

* * * * *